US005407891A

United States Patent [19]

Matsushita et al.

[11] Patent Number: 5,407,891

[45] Date of Patent: Apr. 18, 1995

[54] RECORDING MATERIAL

[75] Inventors: Toshihiko Matsushita; Sadao Morishita, both of Tokyo, Japan

[73] Assignee: Mitsubishi Paper Mills Limited, Japan

[21] Appl. No.: 208,661

[22] Filed: Mar. 10, 1994

Related U.S. Application Data

[60] Division of Ser. No. 22,851, Feb. 25, 1993, Pat. No. 5,308,824, which is a continuation of Ser. No. 765,242, Sep. 25, 1991, abandoned.

[30] Foreign Application Priority Data

Sep. 28, 1990 [JP] Japan ..... 2-259870
Sep. 29, 1990 [JP] Japan ..... 2-260680

[51] Int. Cl.[6] ..... B41M 5/132

[52] U.S. Cl. ..... 503/204; 503/200; 503/207; 503/226

[58] Field of Search ..... 503/200, 207, 208, 226, 503/204; 427/150–152

[56] References Cited

U.S. PATENT DOCUMENTS 4,950,638 8/1990 Yuyama et al. ..... 503/226

FOREIGN PATENT DOCUMENTS 59-54598 3/1984 Japan ..... 503/226
61-228994 10/1986 Japan ..... 503/226

*Primary Examiner*—Pamela R. Schwartz
*Attorney, Agent, or Firm*—Cushman Darby & Cushman

[57] ABSTRACT

The invention provides a recording material inhibited from alteration which comprises a substrate, an undercoat layer containing a white or light colored inorganic fluorescent pigment having an emission maximum wavelength of 400–700 nm and provided on one side of the substrate, and a recording layer provided on said undercoat layer. The recording layer may be a heat-sensitive layer or a pressure-sensitive layer. A magnetic recording layer comprising ferromagnetic powders may be provided on another side of the substrate.

10 Claims, No Drawings

RECORDING MATERIAL

This is a division of application Ser. No. 08/022,851, filed Feb. 25, 1993, now U.S. Pat. No. 5,308,824, which is a continuation of application Ser. No. 07/765,242, filed Sep. 25, 1991, now abandoned.

BACKGROUND OF THE INVENTION

1. Field of the Invention

The present invention relates to a recording material and more particularly to a recording material inhibited from alteration.

2. Related Art

Hitherto, many chemical color formation systems have been known which utilize recording energies such as heat, pressure, light, and electricity. Among them, the color formation system of two-component type comprising a normally colorless or light colored dye precursor and a color developer which reacts with the dye precursor to form a color has been known for a long time and has been widely utilized as a recording material.

For example, there are heat-sensitive recording materials utilizing heat energy, pressure-sensitive recording materials utilizing pressure energy and electro-thermal recording materials utilizing electrical energy.

Especially, the pressure-sensitive recording materials have been generally used like normal papers. In general, the pressure-sensitive recording materials comprise an upper sheet prepared by coating, on a substrate, microcapsules formed by emulsifying a solution of a dye precursor in a suitable solvent to a few microns and then microencapsulating the emulsion, a lower sheet prepared by coating a color developer layer containing a color developer on a substrate and others. The microcapsules coated side and the color developer coated side are brought into contact with each other and when the thus superimposed upper and lower sheets are applied with writing pressure or striking pressure, the microcapsules are ruptured to release the content containing the dye precursor, which transfers to the color developer layer to contact with the color developer and form a color, thereby to form a recorded image.

The heat-sensitive recording materials generally comprise a substrate and, provided thereon, a heat-sensitive recording layer mainly composed of a normally colorless or light colored dye precursor and a color developer. Upon heating by a thermal head, a thermal pen, a laser beam or the like, the dye precursor and the color developer instantaneously react with each other to form a recorded image. These are disclosed in Japanese Patent Kokoku Nos. 43-4160 and 45-14039. These heat-sensitive recording materials have the advantages that records can be obtained by relatively simple devices, maintenance is easy and noise is not generated and they are utilized in a wide variety of the fields such as instrumentation recorders, facsimiles, printers, terminals of computers, labels, vending machines for passenger tickets and the like.

For example, they are utilized for payment slips in banking establishments, for flight tickets and passenger tickets and besides, those which have a magnetic recording layer on the back (a side of the substrate opposite to the side a heat-sensitive recording layer is provided) are utilized for magnetic passenger tickets, magnetic commuter passes, magnetic parking tickets, prepaid cards and the like.

These uses are concerned with monetary exchange and various measures for prevention of alteration have been devised.

Recording systems which use fluorescent materials for prevention of alteration include heat transfer recording sheets, and there have been various examples as disclosed, for example, in Japanese Patent Kokai Nos. 59-54598 and 61-228994.

Japanese Patent Kokai No. 59-54598 relates to a heat-sensitive fluorescent transfer medium comprising a substrate and, provided thereon, a heat-sensitive transfer ink layer containing a fluorescent pigment and a hot-melt adhesive. In such heat-sensitive fluorescent transfer mediums, a fluorescent pigment is used as a colorant and this is for carrying out visual identification with the hue possessed by the fluorescent pigment and for showing up the strong fluorescence. However, there is the defect that visual identification is difficult with the hue of the fluorescent pigment per se. Moreover, in order that visual identification can be performed, a large amount of the fluorescent pigment must be contained therein, resulting in increase of costs.

Japanese Patent Kokai No. 61-228994 relates to a heat transfer recording medium comprising a heat resistant support and, provided thereon, a heat meltable ink layer mainly composed of a colorant, a wax, a binder and a softening agent wherein a fluorescent material is contained in the ink layer and besides, the colorant is one which absorbs little or no fluorescence of the fluorescent material. This aims at solving the defect that the fluorescence of the fluorescent material is absorbed by the colorant to cause reduction of fluorescent intensity. This patent publication illustrates that it is preferred to use the colorant and the fluorescent material of the same color type and red color type colorants for red color type fluorescent materials are mentioned and similarly, blue type and yellow type are mentioned. That is, the recording medium is characterized in combination of colorants and fluorescent materials of the same color type and does not use a combination of different color types. Furthermore, this patent publication has no disclosure relating to a black record image.

As explained above, heat transfer recording sheets comprising a substrate, a heat resistant layer coated on one side of the substrate and a heat meltable ink layer coated on another side of the substrate, a fluorescent material being contained in the heat meltable ink have had various problems for prevention of alteration and regarding inherent properties of recording materials. Besides, these techniques relate to heat transfer recording where fluorescent pigments are contained in the heat meltable ink and these recording materials are restricted in their use.

SUMMARY OF THE INVENTION

The present invention provides a recording material which can be inhibited from alteration of record. That is, the recording material provided by the present invention comprises a substrate, an undercoat layer directly coated on one side of the substrate and containing a white or light colored inorganic fluorescent pigment having an emission maximum wavelength of 400–700 nm, and a recording layer coated on the undercoat layer, wherein according to a first embodiment, the recording layer is a non-color developing recording layer containing substantially no color forming compound, this recording layer usually being mainly composed of a heat meltable substance and containing no substance which brings about a color forming reaction; according to a second embodiment, the recording layer is a heat-sensitive recording layer containing a dye precursor and a color developer which reacts with the dye precursor upon heating to form a color; and according to a third embodiment, the recording layer is a pressure-sensitive recording layer containing a dye precursor and/or a color developer which reacts with the dye precursor to form a color, at least one of which is in encapsulated form.

The recording material of the present invention may further have a magnetic recording layer mainly composed of ferromagnetic powders and coated on another side of the substrate, namely, the side of the substrate which is opposite to the side on which the above-mentioned recording layer is formed.

As examples of the inorganic fluorescent pigments used in the present invention, mention may be made of sulfide type pigments such as CaS:Bi, SrS:Sm:Ce, ZnS:Ag, ZnS:Cu, and ZnS:Cu:Co, and oxyacid salts type pigments such as $Sr_5(PO_4)_3Cl$:Eu, 3(Ba Mg)·8$Al_2O_3$:Eu, ZnO:Zn, $Zn_2SiO_4$:Mn, $Zn_2GeO_4$:Mn, $YVO_4$:Eu, $Y_2O_2S$:Eu, and 0.5$MgF_2$·3.5MgO·$GeO_2$:Mn. These may be used singly or in combination of two or more.

The undercoat layer which is provided between the substrate and the recording layer and which provides a means to inhibit alteration may comprise, in addition to the above-mentioned inorganic fluorescent pigments, inorganic and/or organic pigments generally used in the undercoat layer.

DETAILED DESCRIPTION OF PREFERRED EMBODIMENTS

The recording materials of the present invention can be used for making records of which authenticity entails a danger of being altered, for example, payment slips of banking establishments, flight tickets, passenger tickets, bank checks, and stock certificates. Moreover, the recording materials of the present invention which have a magnetic recording layer coated on the side of the substrate which is opposite to the side on which the heat-sensitive recording layer is coated have uses such as magnetic passenger tickets, magnetic commuter passes, magnetic coupon tickets, magnetic parking tickets, voting papers for horse racing, bicycle racing and motorbike racing, and prepaid cards. These materials relate to monetary transactions and various measures have been taken in an attempt to inhibit alteration.

For complete attainment of inhibition of alteration, it is meaningless if the measure for inhibition can be visually recognized.

In this respect, since the inorganic fluorescent pigment is contained in the undercoat layer between the recording layer and the substrate in the present invention and besides, it is white or light colored and the color is similar to that of the undercoat layer, and in addition the undercoat layer is covered with the recording layer, presence of the pigment cannot be visually recognized. Moreover, the inorganic fluorescent pigment used in the present invention has properties very favorable for inhibition of alteration in that it emits a radiated light such as blue, green or red radiated color when irradiated with a light of specific excitation wavelength such as black light (365 nm) and has its emission maximum wavelength in the range 400–700 nm and hence, cannot be visually recognized under ordinary visible light.

It is identification or discernment of a record on the recording material after it has borne records that is the feature of the present invention in the use of the recording material. This will be explained with reference to the recording material containing a heat meltable substance in the recording layer which is a first embodiment of the present invention. When energy is applied image-wise to the recording layer by a thermal head, a heated portion of the recording layer is melted, but records borne on the recording layer are unidentifiable under visible light since the layer contains substantially no color forming compound. When the recording layer is exposed to light of a specific excitation wavelength such as black light, the records appear in a fluorescent color and can be identified. This is because the heat applied to the recording layer melts the layer image-wise, and the molten portion sinks in the undercoat layer and is in a depressed state, whereby that portion of the under coat layer becomes accessible under that black light, i.e. the fluorescent pigment contained in that portion of the undercoat layer appears in a fluorescent color and can be identified.

When records have been placed by heat energy on the heat-sensitive recording layer, there is no apparent difference between the recorded portion and the unrecorded portion of the recording material of the first embodiment. That is, it is the purpose of this embodiment that records are placed on the recording material without leaving any traces of these having been carried out an act of recording. For this purpose, the color of the heat-sensitive recording layer and that of the undercoat layer are preferably similar.

The main component of the heat-sensitive recording layer is a heat meltable compound and may additionally contain a white inorganic or organic pigment.

The heat meltable compound includes waxes, low-melting point compounds, resins and so on.

Examples of the waxes are paraffin wax, microcrystalline wax, low-molecular weight polyethylene wax, polyethylene oxide wax, synthetic wax, carnauba wax, candelilla wax, rice wax, hardened castor oil, lanolin, montan wax, N-hydroxymethylstearic acid amide, stearic acid amide, and palmitic acid amide.

Examples of the low-melting point compounds are naphthol derivatives such as 2-benzyloxynaphthalene, biphenyl derivatives such as p-benzylbiphenyl and 4-allyloxybiphenyl, polyether compounds such as 1,2-bis(3-methylphenoxy)ethane, 2,2'-bis(4-methxoyphenoxy)diethyl ether and bis(4-methoxyphenyl)ether, and carbonic acid or oxalic acid diester derivatives such as diphenyl carbonate, dibenzyl oxalate and di(p-fluorobenzyl)oxalate.

Examples of the low-melting point resins are polyester resins, polyamide resins, urethane resins, epoxy resins, polystyrene resins, vinyl acetate resins, ethylene-vinyl acetate copolymer, ethylene-ethyl acrylate copolymer, fatty acid hydrocarbon resins and aromatic hydrocarbon resins.

Besides, if necessary, there may be added, for inhibition of wear by a thermal head and for anti-sticking, higher fatty acid metallic salts such as zinc stearate and calcium stearate, waxes such as paraffin, oxidized paraffin, polyethylene, polyethylene oxide, stearic acid amide and castor wax, dispersing agents such as sodium dioctylsulfosuccinate, ultraviolet absorbers such as benzophenone and benzotriazole types, surfactants, and fluorescent dyes.

According to the second embodiment, the recording layer is formed by adding to the heat-sensitive recording layer of the first embodiment a dye precursor and a color developer which allows the dye precursor to develop a color upon heating.

The dye precursors include triarylmethane compounds, diphenylmethane compounds, xanthene compounds, thiazine compounds, and spiro compounds. Examples of them will be enumerated hereinafter.

As the color developers, electron accepting substances generally used in heat-sensitive or pressure-sensitive recording papers are used. Examples of them will also be enumerated hereinafter.

With reference to other components, those which are used in the non-color developing recording layer of the first embodiment can be used as they are and they will not be explained in detail here.

In the heat-sensitive recording material of the second embodiment, also only the thermally recorded portion emits fluorescence. This is because the heat-sensitive recording layer is melted image-wise by the heat of a thermal head and that molten portion sinks into the undercoat layer and thus the recorded image of the heat-sensitive recording layer is depressed and the inorganic fluorescent pigment under the thus depressed portion becomes accessible under a light of a specific excitation wavelength such as black light. In the second embodiment, thermally formed records are visible like ordinary thermal paper, but if those records are altered by a marking means, that alteration can be easily found by subjecting those records to black light since that alteration does not emit fluorescence. In this regards, the heat-sensitive recording material of the present invention has the advantages which have not been seen in conventional techniques.

Next, explanation will be made on the third embodiment which contains the following three types;

(1) a so called "SC (self-contained)" type layer containing a dye precursor and a color developer, at least one of which is microencapsulated;

(2) a so called "CB (coated back)" type layer containing a microencapsulated dye precursor, which on use is juxtaposed with the following type (3) layer; and (3) a so called "CF (coated front)" type layer containing a color developer.

The recording layer of each of said types is provided on the undercoat layer. In the case of the recording layer of type (1), the microcapsules in the layer are ruptured by application of pressure to release the encapsulated component(s), the dye precursor and/or the color developer, bringing about a color forming reaction, and that pressure-applied portion of the layer becomes depressed so that the undercoat layer thereunder becomes accessible under black light. Likewise in the case of the recording layer of type (2) and type (3), pressure-applied portion of the layer becomes depressed and dissolved respectively so that the undercoat layer thereunder becomes accessible under black light.

In embodiments of the type (1) and type (3), records formed by applying pressure are visible like ordinary SC and CF sheets, but if those records are altered by a marking means that alteration can be easily found by subjecting those records to black light since that alteration does not emit fluorescence. In an embodiment of said type (2), there is no apparent difference between the pressure-applied portion and the rest, so that it has the same merit as that of said first embodiment. In this regards, each of said pressure-sensitive recording materials of the present invention, types (1), (2) and (3), has the advantage which has not been seen in conventional techniques.

In all of these embodiments, the inorganic fluorescent pigment in the undercoat layer may be contained in an amount of 0.5–30% by weight based on the total solid of the composition for the undercoat layer. If content of the inorganic fluorescent pigment is less than 0.5% by weight, identification of the pigment is difficult when the material is irradiated with a light of specific excitation wavelength such as black light. On the other hand, when it is more than 30% by weight, there is the possibility that the undercoat layer cannot fully exhibit its oil absorption effect and besides, it causes increase in costs.

As the dye precursors used in the color developable recording layer in the present invention, there may be used any of those which are generally used for pressure-sensitive recording papers or heat-sensitive recording papers. Examples thereof are enumerated below.

(1) Triarylmethane compounds:

3,3-Bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide, and 3-p-dimethylaminophenyl-3-(1-methylpyrrol-2-yl)-6-dimethylaminophthalide.

(2) Diphenylmethane compounds:

4,4'-Bis-dimethylaminophenylbenzhydrylbenzyl ether, N-halophenylleucoauramine, and N-2,4,5-trichlorophenylleucoauramine.

(3) Xanthene compounds:

Rhodamine B anilinolactam, Rhodamine B-p-chloroanilinolactam, 3-diethylamino-7-dibenzylaminofluoran, 3-diethylamino-7-octylaminofluoran, 3-diethyamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, and 3-(N-ethyl-N-tetrahydrofuryl)amino-6-methyl-7-anilinofluoran.

(4) Thiazine compounds:

Benzoylleuco methylene blue and p-nitrobenzoylleuco methylene blue.

(5) Spiro compounds:

3-Methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, and 3-propylspirobenzopyran.

These may be used singly or in combination of two or more.

As the color developers there may be used electron accepting compounds generally used for pressure-sensitive recording papers or heat-sensitive recording papers. Especially, phenol derivatives, aromatic carboxylic acid derivatives or metal compounds thereof and N,N'-diarylthiourea derivatives are used. Among them, especially preferred are phenol derivatives and typical examples thereof are p-phenylphenol, p-hydroxyacetophenone, 4-hydroxy-4'-methyldiphenylsulfone, 4-hydroxy-4'-isopropoxydiphenylsulfone, 4-hydroxy-4'-benzenesulfonyloxydiphenylsulfone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)butane, 2,2-bis(p-hydroxyphenyl)hexane, 1,1-bis(p-hydroxyphenyl)-2-ethylhexane, 2,2-bis (3-chloro-4-hydroxyphenyl)propane, 1,1-bis (p-hydroxyphenyl)-1-phenylethane, 1,3-di[2-(p-hydroxyphenyl)-2-propyl]benzene, 1,3-di[2-(3,4-dihydroxyphenyl)-2-propyl]benzene, 1,4-di[2-(p-hydroxyphenyl)-2-propyl]benzene, 4,4'-dihydroxydiphenyl ether, 4,4'-dihydroxydiphenylsulfone, 3,3'-dichloro-4,4'-dihydroxydiphenylsulfone, 3,3'-diallyl-4,4'-dihydroxydiphenylsulfone, 3,3'-dichloro-4,4'-dihydroxydiphenyl sulfide, methyl 2,2-bis(4-hydroxyphenyl)acetate, butyl 2,2-bis(4-hydroxyphenyl)acetate, 4,4'-thiobis(2-t-butyl-5-methylphenol), bis(3-allyl-4-hydroxyphenyl)sulfone, 4-hydroxy-4'-isopropyloxydiphenylsulfone, 3,4-dihydroxy-4'-methyldiphenylsulfone, benzyl p-hydroxybenzoate, chlorobenzyl p-hydroxybenzoate, propyl p-hydroxybenzoate, butyl p-hydroxybenzoate, dimethyl 4-hydroxyphthalate, benzyl gallate, stearyl gallate, salicylanilide, and 5-chlorosalicylanilide.

In addition, the pressure-sensitive layer may further contain diatomaceous earth, talc, kaolin, calcined kaolin, calcium carbonate, magnesium carbonate, titanium oxide, zinc oxide, silicon oxide, aluminum hydroxide, urea-formalin resin and the like as pigments.

In the case of microencapsulating solutions of the dye precursor or the color developer, there may be used singly or in combination nonvolatile solvents such as diallylmethanes, diarylethanes, alkyldiphenyls, alkylnaphthalenes, chlorinated paraffins, aromatic esters, aliphatic esters, higher alcohols and higher fatty acids.

The microcapsules can be prepared by interfacial polymerization method, in situ method, phase separation method, spray drying method and the like.

As binders used for the undercoat layer and the recording layer (heat-sensitive recording layer or pressure-sensitive recording layer), there may be used various binders which are normally used. Examples thereof are water-soluble binders such as starches, hydroxyethyl cellulose, methyl cellulose, carboxymethyl cellulose, gelatin, casein, polyvinyl alcohol, modified polyvinyl alcohol, sodium polyacrylate, acrylic amide/acrylic ester copolymer, acrylic amide/acrylic ester/methacrylic acid terpolymer, alkali salts of styrene/maleic anhydride copolymer, alkali salts of ethylene/maleic anhydride copolymer, and latices such as polyvinyl acetate, polyurethane, polyacrylic esters, styrene/butadiene copolymer, acrylontrile/butadiene copolymer, methyl acrylate/butadiene copolymer, and ethylene/vinyl acetate copolymer.

As the substrate, paper is mainly used, but there may be optionally used nonwoven fabrics, plastic films, synthetic paper, and metal foils, and these sheets coated with pigments and composite sheets comprising combinations of them.

In all of these embodiments of the present invention, a magnetic recording layer mainly composed of ferromagnetic powders may be provided on the side of the substrate opposite to the side on which the above-mentioned recording layer is provided. A specific signal is magnetically recorded in the magnetic recording layer by a magnetic head and the record can be read by a magnetic head if it is necessary. The magnetically recorded signal can be taken out as an electric signal to actuate various automatic devices. Furthermore, it is also possible to store data by linking with a computer. In those embodiments having a magnetic recording layer on the back, inhibition of alteration is of great significance since they are used mainly as substitutes for money such as magnetic passenger tickets, magnetic commuter passes, magnetic coupon tickets, magnetic parking tickets and prepaid cards. Such money substitutes use is increasing, and for this purpose the recording material of the second embodiment is favored.

The composition of the magnetic recording layer comprises magnetic powders, a binder and other additives.

The magnetic powders include, for example, $\gamma$-$F_2O_3$, $Fe_3O_4$, mixed crystal of $\gamma$-$Fe_2O_3$ and $Fe_3O_4$, Co-containing $\gamma$-$Fe_2O_3$, Co-containing $Fe_3O_4$, Ba-ferrite, and Sr-ferrite. Preferred are Ba-ferrite and Sr-ferrite having the higher coercive force.

As the binder, there may be used polyester resin, vinyl chloride resin, polyurethane resin, vinyl chloride-vinyl acetate copolymer, vinyl chlorideacrylonitrile copolymer, styrene-butadiene copolymer, polyacrylic ester resin, epoxy resin, nitrocellulose, and the like.

If necessary, other additives such as plasticizers, lubricants, antistatic agents, and pigments may be used.

As the pigments used in the undercoat layer, mention may be made of organic pigments such as polyethylene, polystyrene, ethylene-vinyl acetate resin, and urea-formaldehyde resin and inorganic pigments generally used for coated papers such as diatomaceous earth, talc, kaolin, calcined kaolin, calcium carbonate, magnesium carbonate, titanium oxide, zinc oxide, silicon oxide, aluminum hydroxide, zinc hydroxide, and barium sulfate. These may be used singly or in combination of two or more. Among them, pigments having an oil absorption of at least 70 ml/100 g are preferred and calcined kaolin and silicon oxide are especially preferred.

The recording material of the present invention has an undercoat layer which contains a white or lightly colored inorganic fluorescent pigment having an emission maximum wavelength of 400–700 nm and which is provided between the substrate and the recording medium. Use of the inorganic fluorescent pigment enables the recording material of the present invention to be inhibited from alteration. Since it is contained in the undercoat layer and the recording layer is coated thereon, it can be hardly distinguished even under a light of a specific excitation wavelength such as black light as well as under visual light.

In the recording material of the present invention, only the records written authentically on it emit fluorescence under black light, therefore are discernible. In the case of records written thermally (i.e. according to the first and second embodiments), records bearing portions of the heat-sensitive recording layer are melted by the heat of a thermal head or pen, sink into the undercoat layer, and as a result the undercoat layer becomes visible under black light; in the case of records written by pressure (i.e. according to the third embodiment), records bearing portions of the recording layer are collapsed or dissolved by pressure, and as a result the undercoat layer becomes visible under black light.

The present invention is illustrated by the following examples, but they should not be construed as limiting the invention in any manner. In these examples, "part" or "parts" and "%" represent "part(s) by weight" and "% by weight", respectively unless otherwise noted.

EXAMPLE 1

1. Preparation of Coating Composition for Undercoat Layer

A mixture of the following composition was stirred to prepare a coating composition for undercoat layer. The inorganic fluorescent pigment used here was a white powder having the composition $Y_2O_2S$:Eu, having a particle size of 2.2 μm and an emission maximum wavelength of 624 nm and emitting a radiation of red color.

| | |
|---|---|
| Inorganic fluorescent pigment | 15 parts |
| Calcined kaolin | 85 parts |
| Styrene-butadiene copolymer latex (50%) | 24 parts |
| Phosphoric acid-esterified starch (10%) | 60 parts |
| Water | 52 parts |

2. Preparation of Coating Composition for Heat-sensitive Recording Layer

A coating composition for heat-sensitive recording layer having the following composition was prepared.

| | |
|---|---|
| Aluminum hydroxide | 70 parts |
| Paraffin wax (30) | 100 parts |
| Ethylene-vinyl acetate emulsion (50%) | 40 parts |
| Water | 90 parts |

3. Production of Recording Material

A recording material was produced by coating the above coating compositions at the following coating amounts on a base paper of 40 g/m$^2$ in basis weight by a Meyer bar.

| | |
|---|---|
| Undercoat layer | 8 g/m$^2$ |
| Heat-sensitive recording layer | 4 g/m$^2$ |

The thus obtained recording material had white color with no difference between the undercoat layer and the heat-sensitive recording layer.

4. Evaluation of Record

The resulting recording material was processed by a supercalender so that the surface had a Beck smoothness of 400–500 seconds. Letter image was recorded on this recording material by G III FAX tester (TH-PMD manufactured by Ohkura Denki Co.) using a thermal head of 8 dots/mm in dot density and 1300 Ω in head resistance at a head voltage of 22 V for 1.0 ms.

There is no difference between the recorded portion and unrecorded portion of the recorded sample under visible light and the recorded image could not be identified with the naked eye. Then, this recorded sample was irradiated by a fluorescent test lamp (Fl-3S manufactured by Tokyo Kogakuki Co.) in a darkroom. As a result, a letter image of bright red color could be discerned. Furthermore, since the unrecorded portion having no recorded image was covered with the heat-sensitive recording layer, no fluorescent color formation could be discerned.

Moreover, the recorded portion was observed under a light microscope to find that the recorded portion was apparently depressed due to heat melting as compared with the unrecorded portion.

EXAMPLE 2

1. Preparation of Coating Composition for Undercoat Layer

A mixture of the following composition was stirred to prepare a coating composition for undercoat layer. The inorganic fluorescent pigment used here was a white powder having the composition $Y_2O_2S$:Eu, having a particle size of 2.2 μm and an emission maximum wavelength of 624 nm and emitting a radiation of red color.

| | |
|---|---|
| Inorganic fluorescent pigment | 15 parts |
| Calcined kaolin | 85 parts |
| Styrene-butadiene copolymer latex (50%) | 24 parts |
| Phosphoric acid-esterified starch (10%) | 60 parts |
| Water | 52 parts |

2. Preparation of Heat-sensitive Coating Composition

Each of the mixtures having the following composition was pulverized and dispersed by a sand mill until average particle size reached about 1 μm to prepare liquor A and liquor B.

| | |
|---|---|
| Liquor A | |
| 3-Dibutylamino-6-methyl-7-anilinofluoran | 40 parts |
| 10% Aqueous polyvinyl alcohol solution | 20 parts |
| Water | 40 parts |
| Liquor B | |
| Bisphenol A | 50 parts |
| Benzyloxynaphthalene | 50 parts |
| 10% Aqueous polyvinyl alcohol solution | 50 parts |
| Water | 100 parts |

A heat-sensitive coating composition was prepared using these liquor A and liquor B at the following blending ratio.

| | |
|---|---|
| Liquor A | 50 parts |
| Liquor B | 250 parts |
| Zinc stearate (40% dispersion) | 25 parts |
| 10% Aqueous polyvinyl alcohol solution | 216 parts |
| Calcium carbonate | 50 parts |
| Water | 417 parts |

3. Production of Recording Material

A recording material was produced by coating the above coating compositions at the following coating amounts on a base paper of 40 g/m$^2$ in basis weight by a Meyer bar.

| | |
|---|---|
| Undercoat layer | 8 g/m$^2$ |
| Heat-sensitive recording layer | 5 g/m$^2$ |

4. Evaluation of Record

The resulting heat-sensitive recording material was processed by a supercalender so that the surface had a Beck smoothness of 400–500 seconds. Letter image was recorded on this recording material by G III FAX tester (TH-PMD manufactured by Ohkura Denki Co.) using a thermal head of 8 dots/mm in dot density and 1300 Ω in head resistance at a head voltage of 22 V for 1.0 ms.

The letter recorded on the heat-sensitive recording material could be discerned only as a black letter under visible light. Then, this recorded sample was irradiated by a fluorescent test lamp (Fl-3S manufactured by Tokyo Kogakuki Co.) in a darkroom. As a result, a letter image of bright red color could be discerned. Furthermore, since the unrecorded portion having no recorded image was covered with the heat-sensitive recording layer, no fluorescent color emission could be discerned.

Moreover, the recorded portion was observed under a light microscope to find that the recorded portion was apparently depressed due to heat melting as compared with the unrecorded portion.

EXAMPLE 3

1. Preparation of Coating Composition for Undercoat Layer

A mixture of the following composition was stirred to prepare a coating composition for undercoat layer. The inorganic fluorescent pigment used here was a white powder having the composition $Zn_2Ge_4$:Mn, having a particle size of 3.0 μm and an emission maximum wavelength of 534 nm and emitting a radiation of green color.

| | |
|---|---|
| Inorganic fluorescent pigment | 15 parts |
| Urea-formaldehyde resin | 85 parts |
| Styrene-butadiene copolymer latex (50%) | 24 parts |
| Phosphoric acid-esterified starch (10%) | 60 parts |
| Water | 52 parts |

2. Preparation of Coating Composition for Pressure-sensitive Recording Layer (1) Preparation of microcapsules containing dye precursor:

80 Parts of NISSEKI HIGHSOL N-296 (trademark for oil manufactured by Nihon Sekiyu Kagaku Co.) in which 4.0 parts of 3-diethylamino-7-chlorofluoran was emulsified in 100 parts of a 5% aqueous solution of pH 4.0 in which styrene-maleic anhydride copolymer was dissolved together with a small amount of sodium hydroxide. Separately, 10 parts of melamine, 25 parts of 37% aqueous formalin solution and 60 parts of water were adjusted to pH of 9.0 and heated to 60° C. to obtain a transparent melamine-formaldehyde precondensate in 15 minutes. This precondensate was added to the emulsion obtained above and this was stirred for 4 hours with keeping it at 60° C. and then was left to cool to room temperature. The resulting microcapsule dispersion had a solid concentration of 40%.

(2) Preparation of coating composition for pressure-sensitive recording layer:

A coating composition for pressure-sensitive recording layer having the following composition was prepared.

| | |
|---|---|
| Microcapsules containing dye precusor (40%) | 20 parts |
| 3,5-Di-tert-butylsalicylic acid dispersion (30%) | 20 parts |
| Zinc oxide | 10 parts |
| Calcined kaolin | 10 parts |
| Wheat starch | 25 parts |
| SBR latex (40%) | 15 parts |
| Water | 100 parts |

3. Production of Recording Material

A recording material was produced by coating the above coating compositions at the following coating amounts on a base paper of 40 g/m$^2$ in basis weight by a Meyer bar.

| | |
|---|---|
| Undercoat layer | 8 g/m$^2$ |
| Pressure-sensitive recording layer | 7 g/m$^2$ |

The thus obtained recording material had white color with no difference between the undercoat layer and the pressure-sensitive recording layer.

4. Evaluation of Record

A plain paper was superimposed on the resulting recording material so as to contact with the pressure-sensitive recording layer and the surface of the paper was applied with pressure by a ball point pen to make recording.

The recorded portion showed a red image under visible light. Then, this recorded sample was irradiated by a fluorescent test lamp (Fl-3S manufactured by Tokyo Kogakuki Co.) in a darkroom. As a result, a letter image of bright green color could be discerned. Furthermore, since the unrecorded portion having no recorded image was covered with the pressure-sensitive recording layer, no fluorescent color formation could be discerned.

EXAMPLE 4

(1) Preparation of Recording Material

A base paper of 40 g/m$^2$ in basis weight was coated to form an undercoat layer thereon by a Meyer bar with the same coating composition for undercoat layer as that for Example 3 at the coating amount of 8 g/m$^2$. A coating composition for pressure-sensitive recording layer having the following composition which had been prepared in the same manner as in Example 3 was coated on said undercoat layer at the coating amount of 6 g/m$^2$ to obtain a recording material.

| | |
|---|---|
| Microcapsules containing dye precursor (40%) | 50 parts |
| Wheat starch | 50 parts |
| Oxidized starch (10%) | 70 parts |
| Water | 215 parts |

Thus obtained recording material can be used as an upper (CB) sheet for a pressure-sensitive recording material.

(2) Evaluation of Record

A commercially available lower (CF) sheet of a pressure-sensitive recording paper was superimposed on thus obtained recording material so as to contact with the pressure-sensitive recording layer, and the surface of the recording material opposite to the recording layer was applied with pressure by a ball point pen to make recording. No recording was recognized on the surface of the recording layer with the naked-eye since the whole surface including recorded portion remained unchanged apparently. However, when the recording layer was irradiated with a fluorescent test lamp of Fl-3S type in a darkroom, a letter image of bright green color could be discerned (in reversed symmetry).

EXAMPLE 5

(1) Preparation of Recording Material

A base paper of 40 g/m$^2$ in basis weight was coated to form an undercoat layer thereon by a Meyer bar with the same coating composition for undercoat layer as that for Example 3 at the coating amount of 7 g/m$^2$. A coating composition for pressure-sensitive recording layer having the following composition, which had been prepared previously, was coated on said undercoat layer at the coating amount of 6 g/m$^2$.

| | |
|---|---|
| 3,5-Di-tert-butylsalicylic acid dispersion (30%) | 100 parts |
| Zinc oxide | 50 parts |
| Calcined kaolin | 50 parts |
| SBR latex (40%) | 50 parts |
| Water | 500 parts |

Thus obtained recording material can be used as a lower (CF) sheet for a pressure-sensitive recording material.

(2) Evaluation of Record

A commercially available upper (CB) sheet of a pressure-sensitive recording paper was superimposed on thus obtained recording material so as to contact with the pressure-sensitive recording layer, and the surface of said upper layer sheet was applied with pressure by a ball point pen to make recording. The recorded portion showed a red image under visible light. Then, this recorded sample was irradiated by a fluorescent test lamp (Fl-3S manufactured by Tokyo Kogakuki Co.) in a darkroom. As a result, a letter image of bright green color could be discerned.

In the recording material of the present invention, only the recorded image portion emits radiation of a color depending on the kind of the inorganic fluorescent pigment when irradiated with a light of a specific excitation wavelength and the record can be discerned. Thus, effect to inhibit alteration can be obtained and practical value of the recording material of the present invention is very high.

What is claimed is:

1. A pressure sensitive recording material comprising:

a support;

an undercoat layer formed on one side of said support, said undercoat layer comprising a binder, non-fluorescent pigment, and an inorganic fluorescent pigment, said fluorescent pigment having an emission maximum in the 400–700 nm range when illuminated with ultra-violet light; and a pressure sensitive recording layer formed on said undercoat layer.

2. A pressure sensitive recording material according to claim 1, wherein the pressure sensitive recording layer comprises at least a dye developer.

3. A pressure sensitive recording material according to claim 2, wherein the recording layer further comprises a dye precursor.

4. A pressure sensitive recording material according to claim 3, wherein at least one of said dye precursor and said dye developer is microencapsulated.

5. A pressure sensitive recording material according to claim 1, wherein the pressure sensitive recording layer comprises a dye precursor.

6. A pressure sensitive recording material according to claim 5, wherein said dye precursor is microencapsulated.

7. A pressure sensitive recording material according to claim 1 wherein said recording layer further comprises a light-colored pigment.

8. A pressure sensitive recording material according to claim 7 wherein said fluorescent pigment makes up less than 30% by weight of said undercoat layer.

9. A pressure sensitive recording material according to claim 8 wherein a magnetic recording layer is formed on a side of said support opposite said undercoat layer.

10. A pressure sensitive recording material according to claim 7 wherein said fluorescent pigment is at least one sulfide or oxyacid salt pigment selected from the group consisting of CaS:Bi, SrS:Sm:Ce, ZnS:Ag, ZnS:Cu, ZnS:Cu, ZnS:Cu:Co, $Sr_5(PO_4)_3Cl$:Eu, $3(Ba,Mg)\cdot 8Al_2O_3$:Eu, ZnO:Zn, $Zn_2SiO_4$:Mn, $Zn_2GeO_4$:Mn, $YVO_4$:Eu, $Y_2O_2S$:Eu, and $0.5MgF_2\cdot 3.5MgO\cdot GeO_2$:Mn.

* * * * *